US005246020A

United States Patent [19]

Wu

[11] Patent Number: 5,246,020

[45] Date of Patent: Sep. 21, 1993

[54] SWAN-SHAPED COSMETIC CASE

[75] Inventor: Min-Tsun Wu, Tainan, Taiwan

[73] Assignee: Fong Yang Plastic, Ltd., Tainan, Taiwan

[21] Appl. No.: 5,607

[22] Filed: Jan. 19, 1993

[51] Int. Cl.[5] ..... A45D 33/22

[52] U.S. Cl. ..... 132/295; 132/297; 206/581; 206/823

[58] Field of Search ..... 132/286, 294, 295, 296, 132/297, 315; 206/581, 823

[56] References Cited

U.S. PATENT DOCUMENTS

| | | | |
|---|---|---|---|
| D. 73,258 | 8/1927 | Heard | 132/295 |
| D. 74,109 | 12/1927 | Heard | 132/295 |
| 2,720,884 | 10/1955 | Fritz | 132/297 |
| 2,747,586 | 5/1956 | Vogelman | 132/297 |
| 3,441,033 | 4/1969 | Flax | 132/295 |
| 4,815,483 | 3/1989 | DuGrenier et al. | 132/295 |
| 4,936,463 | 6/1990 | Tiramani | 132/315 |
| 5,025,817 | 6/1991 | Wen | 132/295 |

*Primary Examiner*—Gene Mancene
*Assistant Examiner*—Frank A. LaViola
*Attorney, Agent, or Firm*—Pro-Techtor International

[57] ABSTRACT

A cosmetic case constructed in the shape of a swan, the case including hinged elements for opening the left and right wings in an upward manner. Left and right upper layers can also be opened in this manner, and left and right middle layers can be opened, while the upper layers are opened, by a rod protruding from the underside of the upper layer.

1 Claim, 5 Drawing Sheets

SWAN-SHAPED COSMETIC CASE

BACKGROUND OF THE INVENTION

Figure 1:
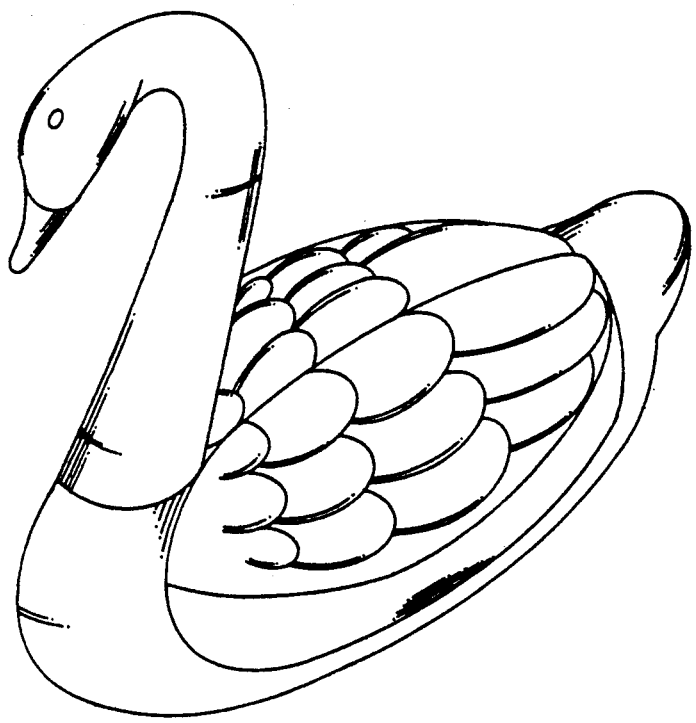

The present invention concerns a swan-shaped cosmetic case. Specifically, the outside design of the cosmetic case is in the shape of a swan.

Conventional cosmetic cases are principally a lift open- or slide open-type, but their construction and appearance are too simple and plain. The inventor of this invention utilizes the shape of a swan as the design of a cosmetic case, thereby enhancing its attractiveness. Additionally, a rotational means is employed for opening the left and right wings in an upward manner. This can also bring about the opening of the left and right upper layers to the left and right respectively, and the opening of the left and right middle layers by means of a protruding rod located on the underside of the upper layer, while the upper layers are being opened. The rear of said cosmetic case can also be drawn out. Said case, when opened fully, is spacious and presents a form that is elegant and statuesque, achieving excellence in both practicality and beauty.

The present invention concerns a swan-shaped cosmetic case. In light of the fact that the construction and appearance of conventional cosmetic cases are too plain, the inventor improved the design. The appearance and form of the resulting cosmetic case possess both statuesque and dynamic beauties, and the construction thereof provides a spacious interior, allowing cosmetics to be placed in different ways as desired. Accordingly, said cosmetic case is extremely functional, and offers the following features:

(1) Many kinds of cosmetics can be placed in said case without problems, because the interior thereof is spacious.

(2) Said case is functional, because the interior arrangement can be changed upon opening the wings.

(3) The form of the wing-opened swan is very elegant, and the shape of a heart is formed when two swans are placed together, which is quite statuesque.

DESCRIPTION OF THE DRAWING FIGURES

FIG. 1: A three-dimensional drawing of the present invention.

Figure 2:
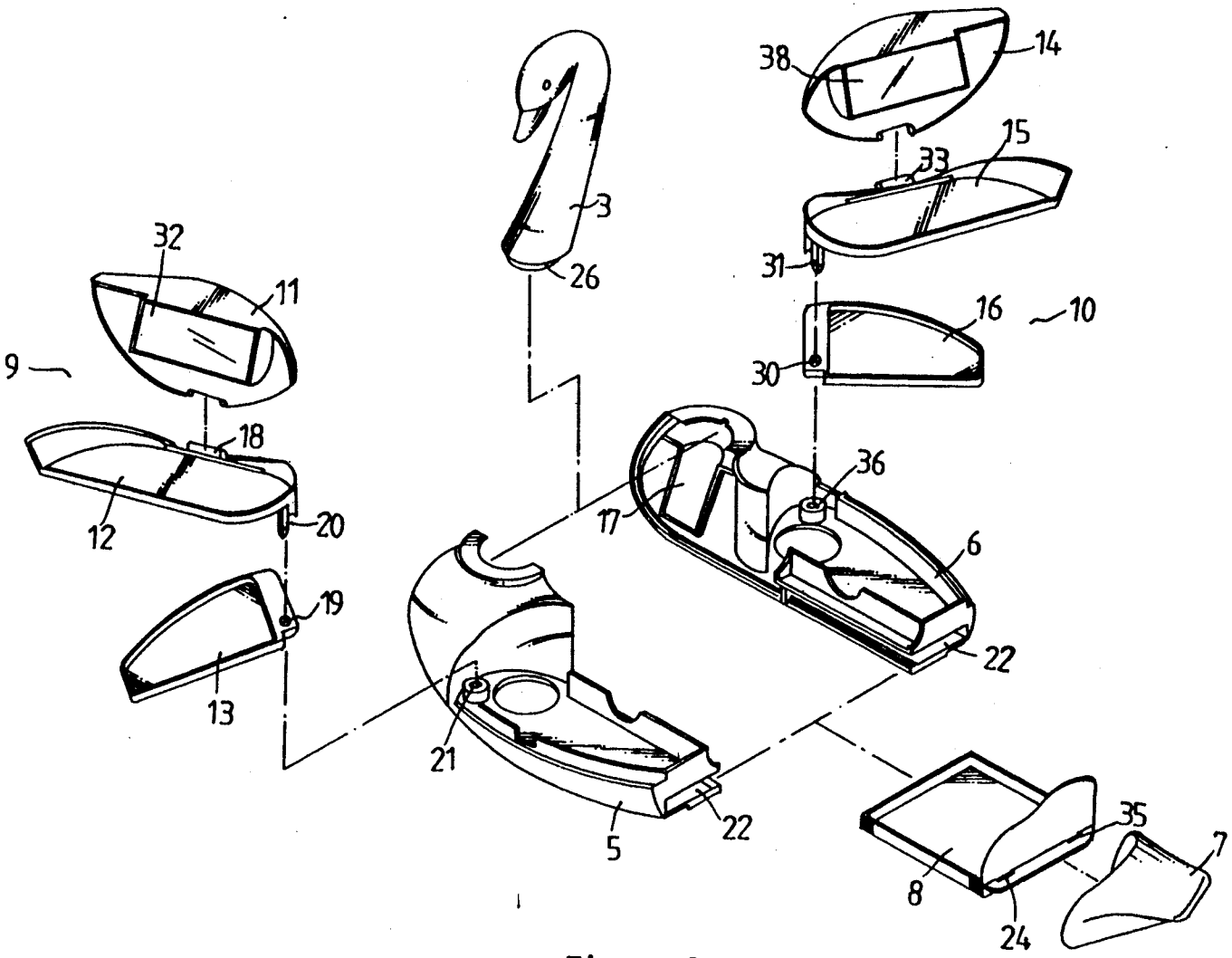

FIG. 2: A three-dimensional exploded drawing of the present invention.

Figure 3:
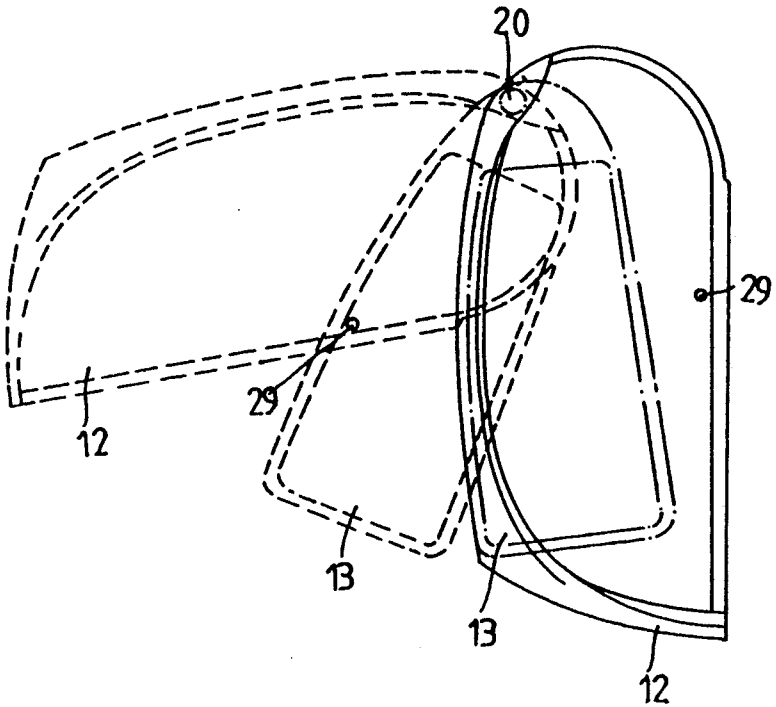

FIG. 3: A drawing showing the opening movements of the left upper and middle layers pertaining to the present invention.

Figure 4:
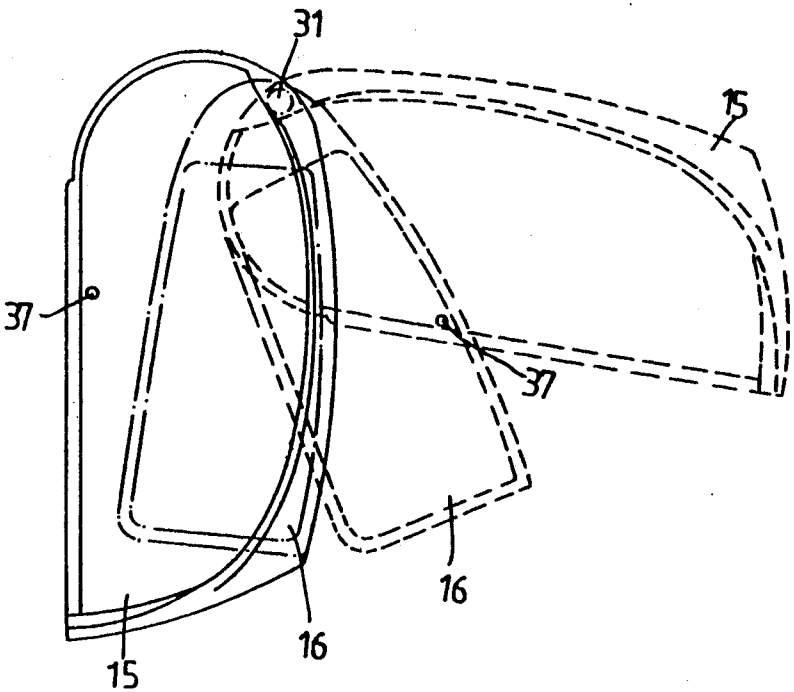

FIG. 4: A drawing showing the opening movements of the right upper and middle layers pertaining to the present invention.

Figure 5:
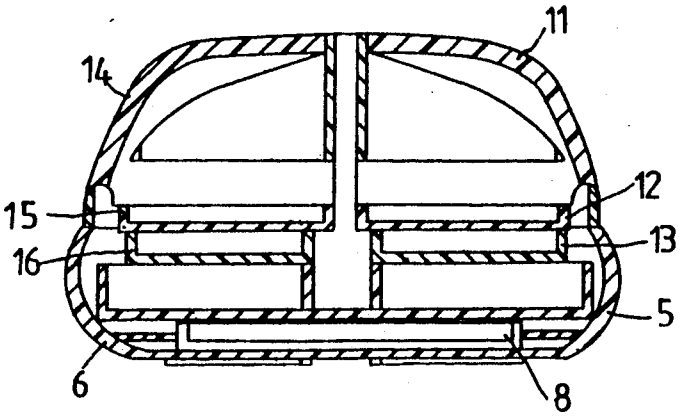

FIG. 5: A left-view dissection drawing of the present invention.

Figure 6:
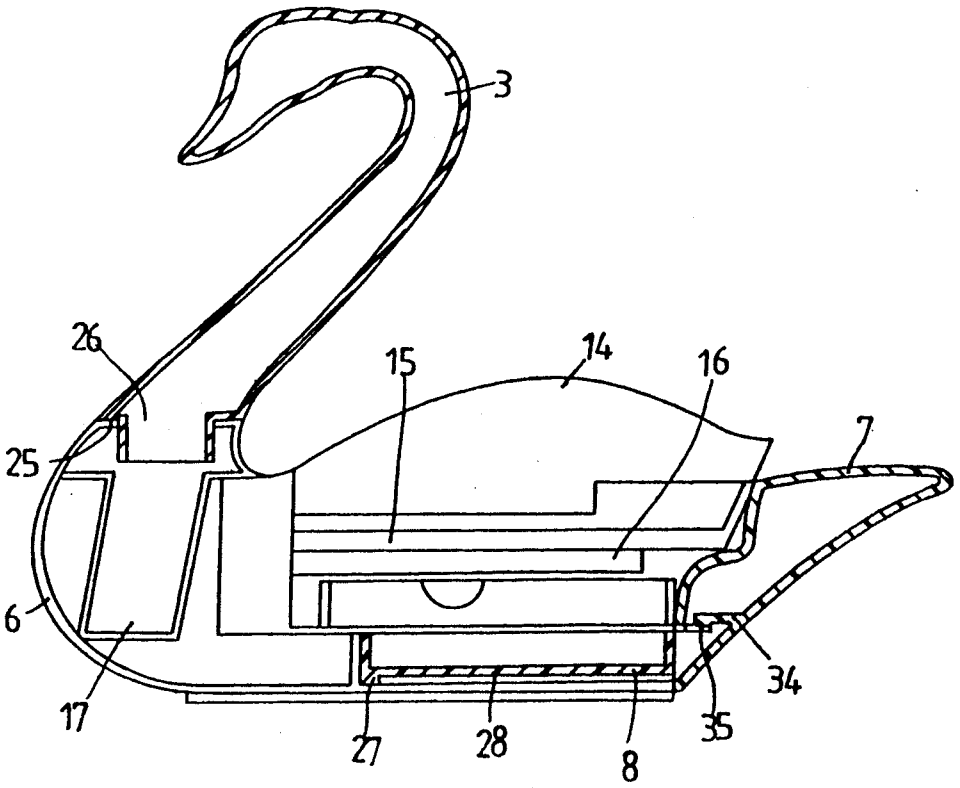

FIG. 6: A direct-view dissection drawing of the present invention.

Figure 7:
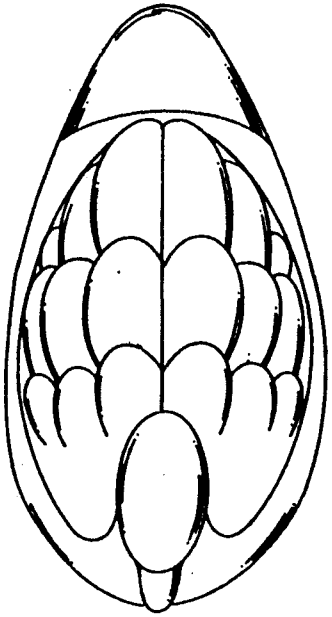

FIG. 7: A top-view drawing of the present invention.

Figure 8:
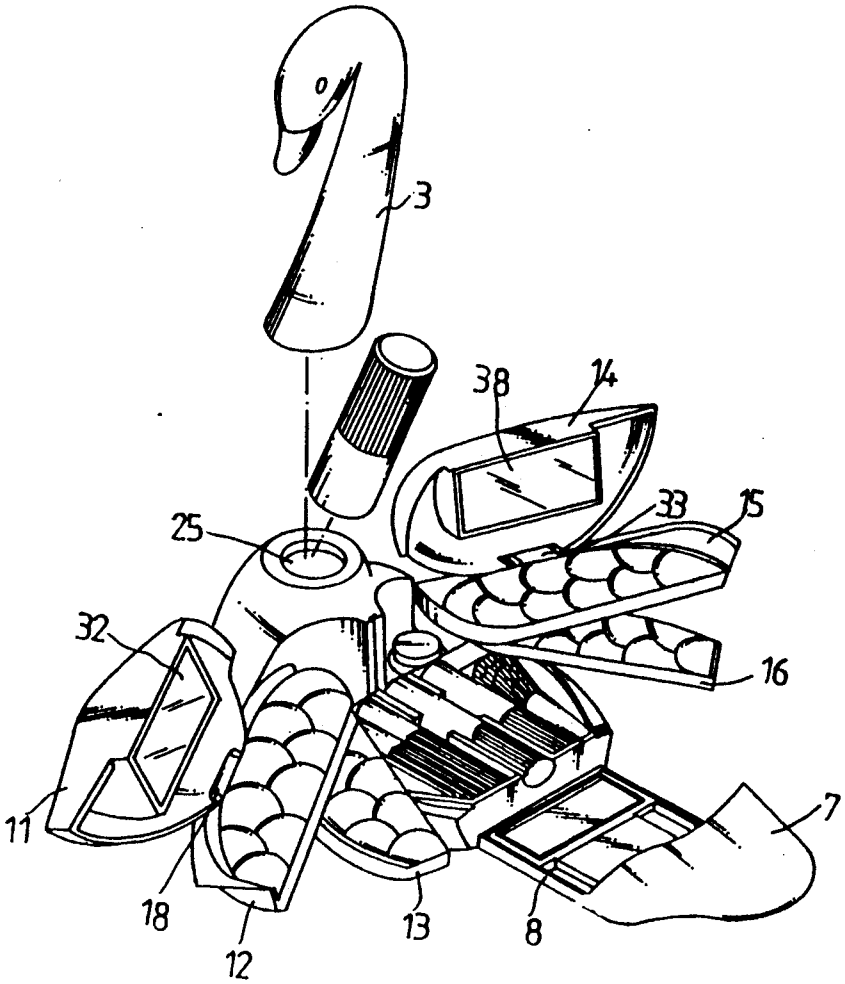

FIG. 8: A three-dimensional drawing of an opened-swan cosmetic case pertaining to the present invention.

| Description of the Notations | |
|---|---|
| 1. Upper lid | 19. Through hole |
| 2. Lower lid | 20. Clipping pin |
| 3. Head of swan | 21. Through hole |
| 5. Left lower body of swan | 22. Square lot |

-continued

| Description of the Notations | |
|---|---|
| 6. Right lower body of swan | 23. Tongue |
| 7. Tail of swan | 24. Square groove |
| 8. Rear lower section of swan | 25. Cylindrical slot |
| 9. Left-wing side | 26. Cylinder |
| 10. Right-wing side | 27. Tongue |
| 11. Left wing | 28. Slot |
| 12. Left upper layer | 29. Protruding rod |
| 13. Left middle layer | 30. Through hole |
| 14. Right wing | 31. Clipping pin |
| 15. Right upper layer | 32. Mirror |
| 16. Right middle layer | 33. Turnable button |
| 17. Rouge compact | 34. Tongue |
| 18. Turnable button | 35. Square groove |
| 37. Protruding rod | 36. Through hole |
| 38. Mirror | |

As depicted in FIGS. 1 and 2, the present invention comprises Head of Swan 3, Left Lower Body of Swan 5, Right Lower Body of Swan 6, Tail of Swan 7, Rear Lower Section of Swan 8, Left-wing Side 9 and Right-wing Side 10, wherein Left-wing Side 9 comprises Left Wing 11, Left Upper Layer 12 and Left Middle Layer 13, and Right-wing Side 10 comprises Right Wing 14, Right Upper Layer 15 and Right Middle Layer 16. The principal characteristics are as follows: The fringe of Right Lower Body of Swan 6 is designed as a female clip, the fringe of Left Lower Body of Swan 5 is designed as a male clip, and Right Lower Body of Swan 6 and Left Lower Body of Swan 5 are joined by said clips. Left Wing 11 and Left Upper Layer 12 are connected by means of Turnable Button 18, which also functions as a fulcrum for the opening operation. Through Hole 19, which is located at the left upper corner of Left Middle Layer 13, is placed into Clipping Pin 20 at the left upper corner of the underside of Left Upper Layer 12 (see FIG. 3), and said Clipping Pin 20 is then inserted into Through Hole 21 on Left Lower Body of Swan 5. Right Wing 14 and Right Upper Layer 15 are connected also by means of a turnable button 33, which functions as a fulcrum for the opening operation. Through Hole 30, which is situated at the right upper corner of Right Middle Layer 16, is placed into Clipping Pin 31 at the right upper corner of the underside of Right Upper Layer 15, and said Clipping Pin 31 is then inserted into Through Hole 36 on Right Lower Body of Swan 6. Rear Lower Section of Swan 8 is inserted into Square Slot 22 formed by joining Right Lower Body of Swan 6 and Left Lower Body of Swan 5. Tail of Swan 7 is equipped with two tongues 23 and 34 (see FIG. 6), and said tongues are inserted into the two square grooves 24 and 35 on the rear lower part of swan. The neck portion formed a rouge compact 17 and a cylindrical slot 25, when Right Lower Body of Swan 6 and Left Lower Body of Swan 5 are joined. The bottom part of Head of Swan 3 possesses Cylinder 26, which is slightly smaller than Cylindrical Slot 25. Head of Swan 3 and the swan body are joined by inserting Cylinder 26 into Cylindrical slot 25, also allowing the head to turn at various angles.

A practical application is depicted in FIG. 8. Specifically, Rear Lower Section of Swan 8 is drawn out; Tongue 27, which is located in the front section of the bottom part of Rear Lower Section of Swan 8, slides along Slot 28 formed by Right Lower Body of Swan 6 and Left Lower Body of Swan 5 and also prevents Rear Lower Section of Swan 8 from falling out; Left Wing 11 and Right Wing 14 are opened in an upward manner, followed by turning Left Wing 11 and Right Wing 14 outward; both Left Upper Layer 12 and Right Upper Layer 15 are equipped with a protruding rod 29 and 37 on their undersides (see FIGS. 3 and 4), and said protruding rods cause Left Middle Layer 13 and Right Middle Layer 16 to open outward, when Left Wing 11 and Right Wing 14 are being opened. The inside of Left Wing 11 and Right Wing 14 is equipped with Mirrors 32 and 38 respectively for use when applying make-up. When opened, the exposed layers can be used for storing various cosmetics. For example, powder compacts can be placed in Left Upper layer 12, Left Middle Layer 13, Right Upper Layer 15 and Right Middle Layer 16, lipsticks can be placed in Rouge Compact 17, powder compacts and discs can be placed in Rear Lower Section of Swan 8, and the space formed by Left Lower Body of Swan 5 and Right Lower Body of Swan 6 can be utilized for storing mascaras, and eye shadow brushes. The head of the swan can be adjusted to any angle as desired. When opened, said cosmetic case looks very unique and provides many compartments for practical utilizations.

What I claim is:

1. A swan-shaped cosmetic case comprising:

a swan head, swan tail, swan rear lower section, swan left and right lower body, and left and right wing sides, the left and right lower bodies being mirror images of each other and the left and right wings being mirror images of each other, wherein the wing sides each include a wing, an upper layer and a middle layer, and wherein the swan right lower body and the swan left lower body include female and male clip elements at their outer edges, the clip elements binding the left lower body and the right lower body together, and wherein the wings and upper layers are connected by means of a turnable button, the button also functioning as a fulcrum for opening operations, through holes being located on an inner front corner of the middle layers to receive a clipping pin located on an inner front corner of an underside of the upper layer, the swan rear lower section being inserted into a slot formed by the left and right lower bodies, the swan tail being equipped with two tongues which are inserted into square grooves on the swan rear lower section, and wherein a neck section of the lower bodies forms a cylindrical slot when the lower bodies are joined, a cylinder on a bottom part of the swan head being inserted into the cylindrical slot, thereby connecting the swan head and the swan body.

* * * * *